US006343941B1

(12) United States Patent
Kan

(10) Patent No.: US 6,343,941 B1
(45) Date of Patent: Feb. 5, 2002

(54) GROUNDING MECHANISM USED IN TERMINAL CONNECTOR STRUCTURES

(76) Inventor: Shin Nan Kan, No. 209, Sec. 2, Chung Chen Road, Hu Kou Hsiang, Hsinchu Hsien (TW)

( * ) Notice: Subject to any disclaimer, the term of this patent is extended or adjusted under 35 U.S.C. 154(b) by 0 days.

(21) Appl. No.: 09/544,819

(22) Filed: Apr. 7, 2000

(51) Int. Cl.[7] ..... H01R 4/66
(52) U.S. Cl. ..... 439/95; 439/607; 439/609
(58) Field of Search ..... 439/95, 79, 108, 439/607

(56) References Cited

U.S. PATENT DOCUMENTS 5,288,248 A * 2/1994 Chen ..... 439/609
5,975,957 A * 11/1999 Noda et al. ..... 439/609
6,050,854 A * 4/2000 Fang et al. ..... 439/607

* cited by examiner

*Primary Examiner*—Tho D. Ta
*Assistant Examiner*—Ann McCamey
(74) *Attorney, Agent, or Firm*—Rosenberg, Klein & Lee

(57) ABSTRACT

The grounding mechanism used in terminal connector structures according to the present invention mainly comprises a connector body and a front panel. The front panel is provided on the middle segment along two sides with a resilient tab projecting forward. The front panel is mounted on the front face of the connector body. Using the resilient tabs to press against the enclosure of a computer on the inner wall surface can get a positive electrical grounding effect. Thus it can reduce electronic interference and has a useful value in the industry.

2 Claims, 4 Drawing Sheets

GROUNDING MECHANISM USED IN TERMINAL CONNECTOR STRUCTURES

BACKGROUND OF THE INVENTION

Prior art terminal connectors typically have an outer metal housing and a front panel attached to the front face thereof. The front panel is disposed at an opening to provide protection and shielding effects. To achieve a good grounding effect, the panel is further provided with resilient fingers so that when the connector is installed in a computer it can firmly contact with the computer enclosure, FIG. 1 shows such a typical prior art connector structure. However, the connector structure design, in which the panel (2) is machined to have a slit skirt, is detrimental to the coupling strength between the front panel (2) and the connector body (1). Furthermore, the way of using raised corners of a panel as contacting means also bring inconvenience to the assemblage of connectors.

In view of the above drawbacks, the primary object of the invention is to provide a novel grounding mechanism used in a terminal connector, in which a specially designed panel having curved resilient tabs is used to enhance the applicability and convenience in use. Now the present invention will be described in detail with reference to the accompanying drawings.

BRIEF DESCRIPTION OF ACCOMPANYING DRAWINGS

DETAILED DESCRIPTION OF THE INVENTION

Figure 1:
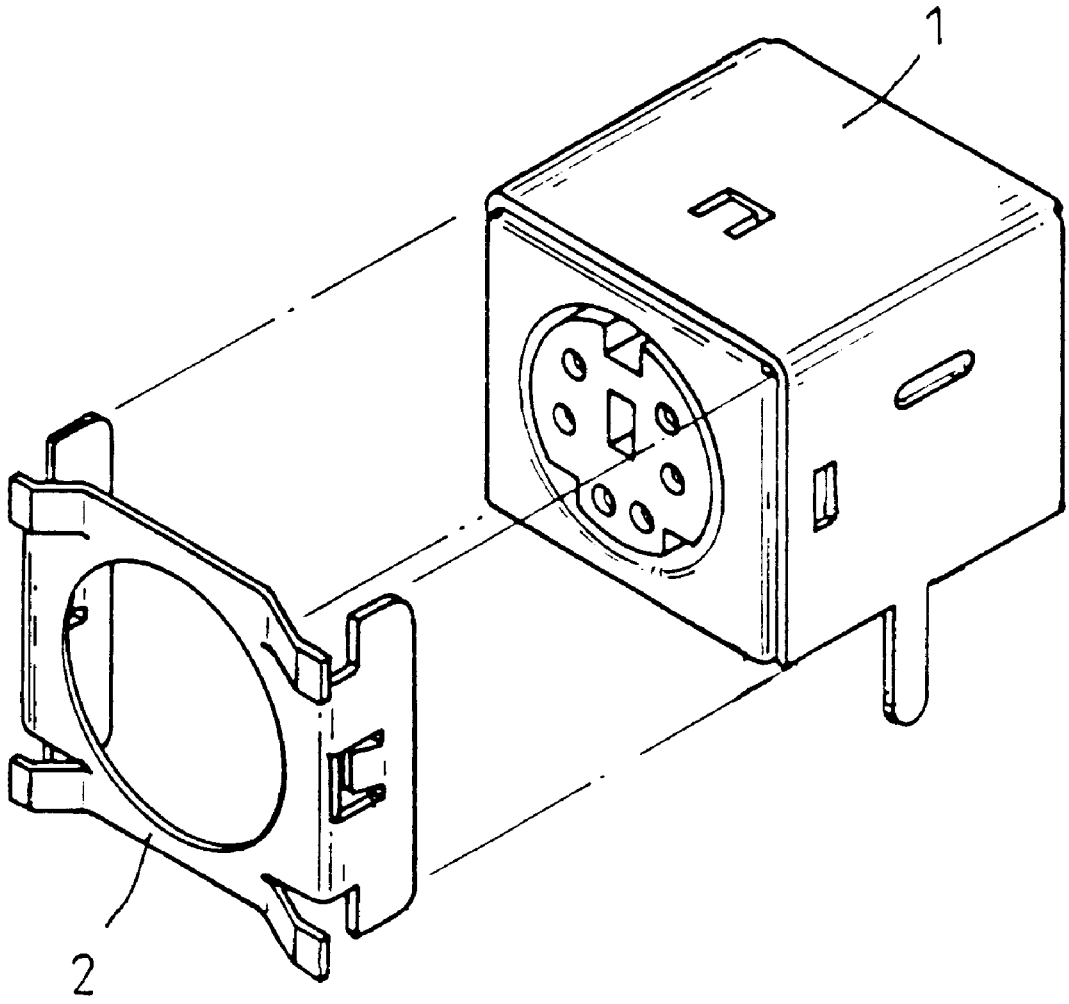
FIG. 1 (prior art)
FIG. 1 is a perspective view showing a grounding mechanism used in a prior art terminal connector.
Figure 2:
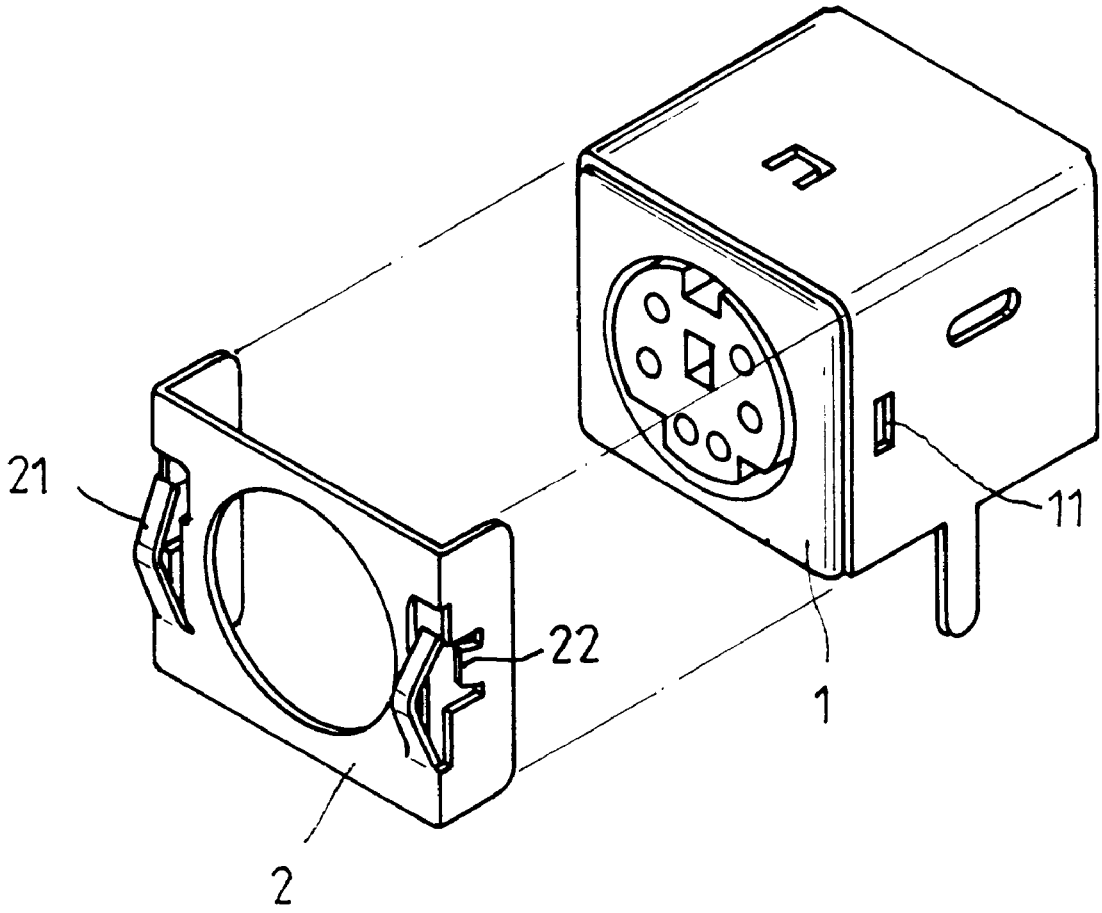
FIG. 2 is a perspective view showing the grounding mechanism according to the invention.
Figure 3:
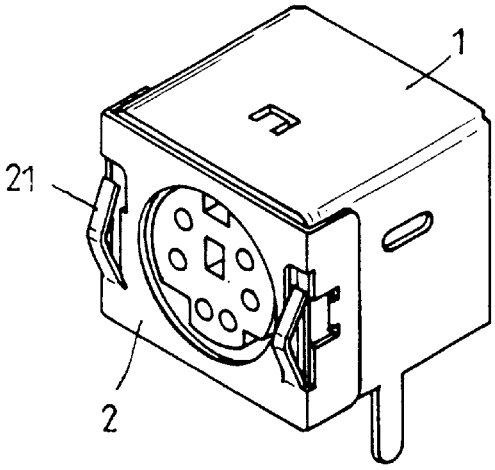
FIG. 3 is a perspective view showing the outer appearance of the terminal connector according to the invention in an assembled state.
Figure 4:
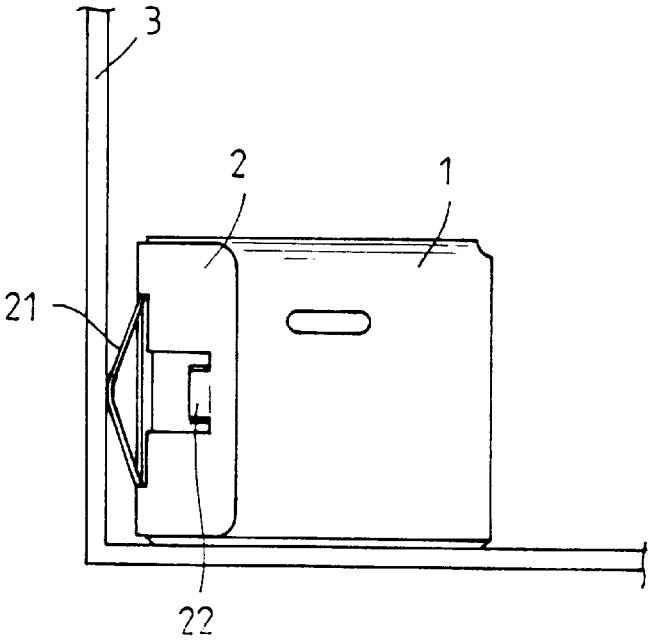
FIG. 4 is a plan view showing an exemplary application of the connector of FIG. 3.

Referring to FIGS. 2 through 4, the invention includes a connector body (1) and an improved panel (2). The body (1) is provided with a receptacle on its front face and an engaging recess (11) on two sides. The panel (2) comprises an inwardly inclined finger (22) on two vertically extending sidewalls. The panel (2) is further equipped with raised bent resilient tabs (21) on the central portion thereof. When a panel (2) is installed on a connector body (1), the panel (2) embraces the connector body (1) with these two inwardly inclined fingers (22) respectively falling into an engaging recess (11). Thus the panel (2) can be firmly attached to the front face of a connector body (1). Besides, in the application of connectors in a computer, the connectors can be easily installed, with the raised portion of the resilient tabs (21) closely contacting with the interior surface of the computer enclosure (3) to obtain an effective grounding.

Figure 5:
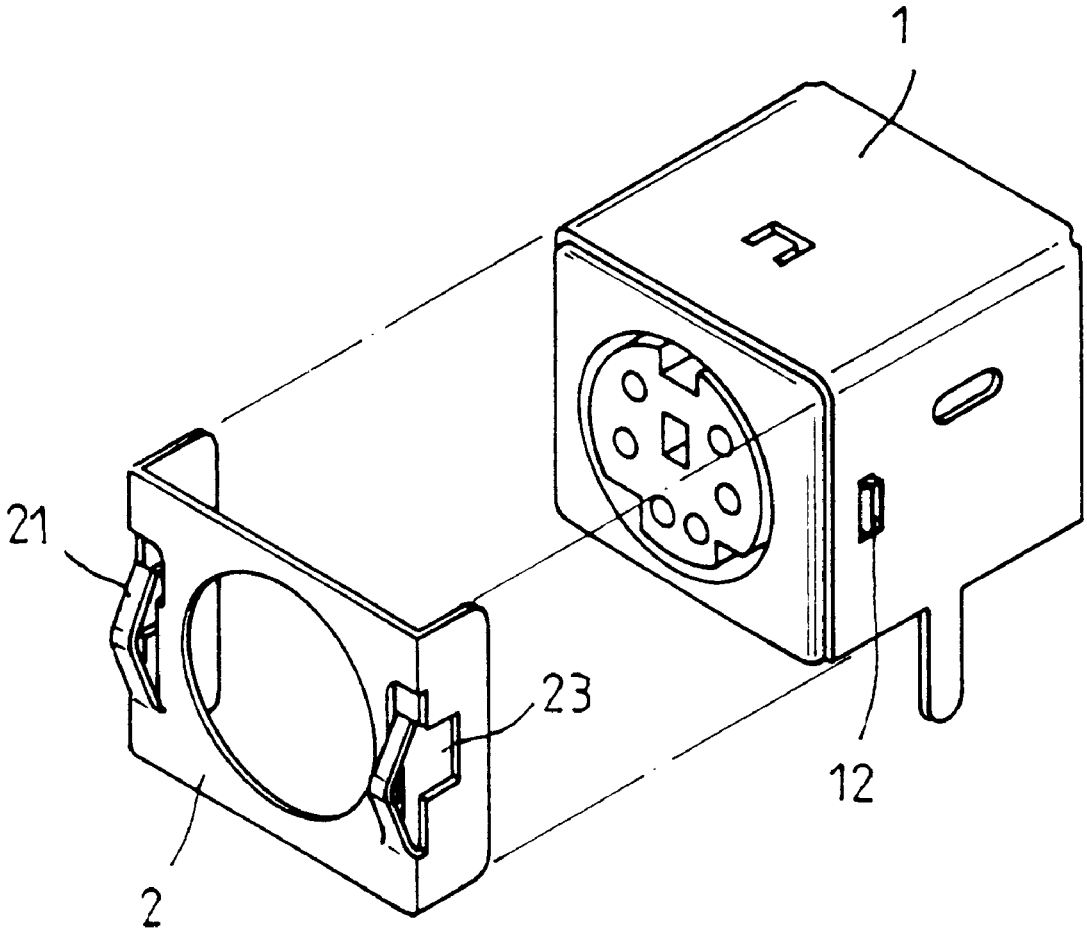
FIG. 5 is a variant application example of the connector according to the invention.

Because that the raised portion of a resilient tab (21) is located in the central zone, it provides convenience in assemblage of terminal connectors. Also, the elastic contact between the tabs and a computer enclosure will not bring any bad influence to the connector. It indeed can produce an optimized grounding effect, superior to prior art connector structures. Further, an alternative embodiment according to the present invention is shown in FIG. 5. In this case, the engaging recesses (11) of the connector body (1) are substituted by embossed blocks (12) and the inclined fingers (22) on two side portions of the panel (2) are replaced by two notches (23). By means of an engagement between the notch (23) and the embossed block (12), the panel can be attached to a connector body with a greater coupling strength.

In brief, the present invention uses bent resilient tabs, differing from inclined fingers according to a prior art, to achieve a releasable elastic grounding contact as well as to provide convenience in assemblage. It indeed has essence of a patent. We hereby apply for patent granting.

What is claimed is:

1. A grounding mechanism for a terminal connector structure comprising:

a terminal connecting body having a pair of sidewalls, each of said sidewalls having an engaging opening formed therethrough;

a shielding panel secured to said terminal connecting body, said shielding panel having a pair of engaging fingers formed thereon, said pair of engaging fingers being received by said pair of engaging openings for holding said shielding panel in removable electrical contact with said terminal connecting body, said shielding panel having a pair of cantilevered spring members integrally formed thereon, each of said cantilevered spring members having a substantially V-shaped contour, a free end of each of said pair of cantilevered spring members extending through a respective opening of said shielding panel and being in electrical communication with said terminal connecting body when said shielding panel is positioned against a grounding structure.

2. A grounding mechanism for a terminal connector structure comprising:

a terminal connecting body having a pair of sidewalls, each of said side walls having an engaging finger formed thereon;

a shielding panel secured to said terminal connecting body, said shielding panel having a pair of engaging openings formed therethrough, said pair of engaging fingers being received by said pair of engaging openings for holding said shielding panel in removable electrical contact with said terminal connecting body, said shielding panel having a pair of cantilevered spring members integrally formed thereon, each of said cantilevered spring members having a substantially V-shaped contour, a free end of each of said pair of cantilevered sapling members extending through a respective opening of said shielding panel and being in electrical communication with said terminal connecting body when said shielding panel is positioned against a grounding structure.

* * * * *